United States Patent [19]

Michael

[11] 4,028,908

[45] June 14, 1977

[54] SCHOOL RING CHARM WITH DANGLING SCHOOL INDICIA

[76] Inventor: John Graham Michael, c/o Brown Wholesale Company, 2095 N. 63rd St., Wynnewood, Pa. 19151

[22] Filed: Feb. 21, 1974

[21] Appl. No.: 444,335

[52] U.S. Cl. ..... 63/23; 63/31

[51] Int. Cl.[2] ..... A44C 25/00

[58] Field of Search ..... 63/13, 31, 23, 20, 21; D45/17 R; D11/79, 50

[56] References Cited

UNITED STATES PATENTS

| | | | |
|---|---|---|---|
| 331,638 | 12/1885 | Hathaway | 63/13 |
| 369,649 | 9/1887 | Moegling | 63/20 X |
| 378,043 | 2/1888 | Edge | 63/13 |
| 466,344 | 1/1892 | Groenman | 63/20 |
| 1,441,924 | 1/1923 | Hartmann | 63/21 X |
| 1,732,250 | 10/1929 | Wehse | 63/13 X |
| 2,931,196 | 4/1960 | Liftman | 63/31 |
| 3,739,599 | 6/1973 | Melone | 63/13 X |
| D156,137 | 11/1949 | Majeska | D45/17 |

FOREIGN PATENTS OR APPLICATIONS

| | | | |
|---|---|---|---|
| 564,920 | 12/1932 | Germany | 63/21 |
| 401,560 | 5/1966 | Switzerland | 63/23 |

OTHER PUBLICATIONS

Blue Book, Jewellers' (see previous citation, Paper No. 2) p. 342 relied on.

Wakmann Watch Co., Inc., Catalog received in U.S. Patent Office Dec. 1, 1963–back cover only relied on.

Blue Book, Jewellers'–published 1926 by Norris Allister–Bell Co., Chicago, Ill., pp. 221 and 290 relied on.

*Primary Examiner*—F. Barry Shay

*Attorney, Agent, or Firm*—Smith, Harding, Earley & Follmer

[57] ABSTRACT

A miniature school ring charm in which a member displaying information of school-related significance is mounted on the center of the shank of the ring so as to dangle within the finger area of the ring when the ring is supported in an inverted position on a neck chain or the like.

10 Claims, 8 Drawing Figures

73
TEFFT
1971

SCHOOL RING CHARM WITH DANGLING SCHOOL INDICIA

BACKGROUND OF THE INVENTION

This invention relates generally to charms and more particularly to a miniature school ring charm or prom favor.

Charms of the indicated type are provided with a loop on the shank for suspension from a charm bracelet or neck chain from which it is supported in an inverted position as a charm. The ring top is generally provided with a bezel having the school name engraved in an area encircling a school-color faceted stone. However, since the ring is worn in a manner such that it is supported in an inverted position with the bezel facing downwardly, the ring top is not very visible. Moreover, the sides of the ring, which are generally provided with the school emblem and the year, are also not particularly visible from most positions and any information thereon cannot be understood easily since it is presented to the viewer in an inverted position. Accordingly, the information of school-related significance appearing on the charm is not displayed very well.

SUMMARY OF THE INVENTION

It is the general object of the invention to provide a school ring charm which provides a clear and attractive display of information having school-related significance.

Briefly stated, the general object of the invention is achieved by utilizing the finger area of the ring for the display of the information of school-related significance. In accordance with the invention a member providing information of school-related significance is attached to the center of the shank of the ring to freely dangle within the finger area of the ring. This dangling freely-moving type of mounting provides an eye-catching and clearly visible display of the member providing the information of school-related significance. Moreover, the dangling member is framed within the ring much the same as a picture is framed. In addition to this attractive arrangement, the ring provides protection for the dangling member.

DETAILED DESCRIPTION OF THE PREFERRED EMBODIMENTS

Figures 1, 2, 3, 4, 5, 6, 7, 8:
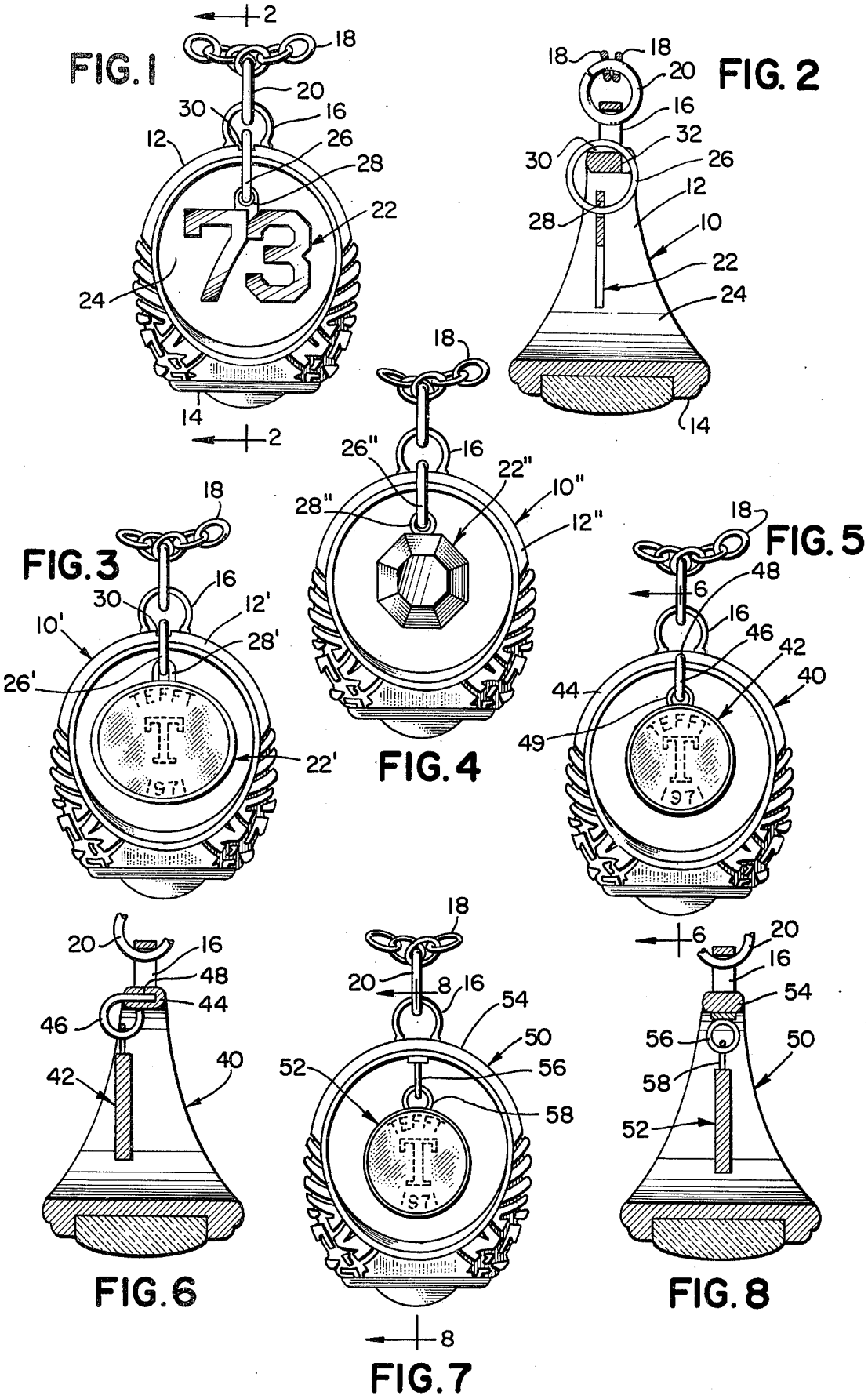
FIG. 1 is an enlarged front view of a miniature school ring charm in accordance with the invention.
FIG. 2 is a sectional view taken on line 2—2 of FIG. 1.
FIG. 3 is an enlarged front view of an alternative embodiment of the invention.
FIG. 4 is an enlarged front view of another alternative embodiment of the invention.
FIG. 5 is an enlarged front view of still another alternative embodiment of the invention.
FIG. 6 is a sectional view taken on line 6—6 of FIG. 5.
FIG. 7 is an enlarged front view of a further alternative embodiment of the invention.
FIG. 8 is a sectional view taken on line 8—8 of FIG. 7.

Although specific terms are used in the following description for clarity, these terms are used to refer only to the structure shown in the drawings and are not intended to define or limit the scope of the invention. For example, the description refers to a member displaying "information of school-related significance" and is intended to include, among other things, such items as class or school numerals; a disk engraved with the theme of a prom, the class or school letters or the school name, etc.; or a faceted stone in the school color.

Referring now to the specific embodiments of the invention selected for illustration in the drawings, there is shown in FIGS. 1 and 2 in enlarged scale a miniature school ring charm of the type which would typically be given at a school dance as a souvenir for those who attend the dance. The ring is indicated generally at 10 and is composed of a shank 12 and a ring top 14 which is generally provided with an engraved bezel and a school stone adhesively mounted in the center of the bezel. The ring 10 is shown in the inverted position in FIGS. 1 and 2 and this is its normal position as displayed on a neck chain or the like. Centrally located on the outside of the shank 12 is a small loop 16 which is utilized to connect the ring to a neck chain 18 by means of an eyelet 20.

In accordance with the invention, a member 22 providing information of school-related significance is mounted on the ring 10 to be positioned within the finger area 24 of the ring 10. Specifically, a member 22 is dye struck with the class numerals "73".

Means are provided so that the member 22 hangs loosely or dangles in the finger area 24 in approximately the center thereof. To this end, an eyelet 26 is engaged within the loop 16 and within a hole 28 in the upper end of the member 22. At the outside center portion of the shank 12 there is provided a groove 30 extending from front to back. There is also provided a groove 32 extending downwardly from the groove 30 and located in the back of the shank 12. The eyelet 26 is adapted to rest within the grooves 30 and 32 whereby the eyelet 26 is centered on the shank 12. Moreover, since the groove 32 is located in the rear of the shank 12 the dangling member 22 is supported toward the front of the ring 10 to make it more visible.

It will be apparent that the miniature school ring 10 shown in FIGS. 1 and 2 utilizes the finger area of the ring for the display of information of school-related significance. The dangling member 22 provides an eye-catching and clearly visible display of the information of school-related significance provided thereon. Moreover, the dangling member 22 is attractively and protectively framed within the ring 10. Dangling member 22 showcases school indicia.

FIG. 3 illustrates a miniature school ring 10' having another type of member for displaying information of school-related significance, namely, a disk 22' engraved on one face with information such as the school letter and name and the class numeral. The disk 22' is provided with a loop 28' engaged by an eyelet 26' for mounting the disc 22' on the center of the shank 12' of the ring 10' in the same dangling manner as the embodiment shown in FIGS. 1 and 2.

FIG. 4 illustrates a miniature school ring 10'' having still another type of member for displaying information of school-related significance, namely, a faceted stone 22'' in the school color. The stone 22'' is provided with a loop 28'' engaged by an eyelet 26'' for mounting the stone 22'' on the center of the shank 12'' of the ring 10'' in the same dangling manner as the embodiment shown in FIGS. 1 and 2.

FIGS. 5 and 6 illustrate a miniature school ring 40 provided with an alternative type of means for mounting the dangling member on the shank of the ring. The ring 40 has a disk member 42 providing information of school-related significance mounted on the ring shank 44 by means of a bent wire 46. The wire 46 has a straight portion extending into and fitted tightly within a drilled hole 48 in the center of the shank 44 and opening at a lateral face thereof, as shown in FIG. 6. The wire 46 is bent downwardly from the straight portion to form an eyelet within the finger area of the ring 40. The dangling disk member 42 is provided with a loop 49 engaged within the eyelet of the wire 46 so as to be loosely mounted within the finger area of the ring as shown in the FIGS. 5 and 6. If desired, a small amount of adhesive may be utilized to secure the straight portion of the wire 46 within the drill hole 48.

FIGS. 7 and 8 illustrate a miniature school ring 50 provided with an alternative type of means for mounting the dangling member on the shank of the ring. The ring 50 has a disk member 52 providing information of school-related significance mounted on the ring shank 54 by means of soldering. To this end, an eyelet providing member 56 is soldered to the inside of the shank 54 at a central location. The eyelet member 56 is in engagement with a loop 58 of the disk member 52 as is shown in FIGS. 7 and 8 so that the disk member 52 is loosely mounted within the finger area of the ring 50.

It is to be understood that the forms of the invention herewith shown and described are to be taken as illustrative and various changes may be made in the shape, size and arrangement of the parts. For example, equivalent elements may be substituted for those illustrated and described herein, parts may be reversed, and features of the invention may be utilized independently of the use of other features, all without departing from the spirit of the invention.

I claim:

1. A school ring charm comprising a school ring having a shank and a ring top defining a finger aperture, display means on the ring for displaying information of school-related significance, dangling means for making eye-catching movement in said finger aperture, and mounting means for dangling said dangling means within the finger aperture of said ring, said dangling means being framed and protected in the finger aperture by the ring shank and top to permit said dangling eye-catching movement, said mounting means being connected to said ring shank at a central location thereof to support said dangling means so that said dangling means dangles within the finger aperture of said ring when said ring is in an inverted position with the ring top facing downwardly, said dangling means comprising a dangling member which showcases school indicia.

2. A school ring charm according to claim 1, wherein said dangling means comprises a faceted stone in the school color.

3. A school ring charm according to claim 1 including means for attaching said ring to a neck chain or the like to support said ring in an inverted position.

4. A school ring charm according to claim 3 wherein said mounting means includes an eyelet encircling said ring shank at a central location thereof.

5. A school ring charm according to claim 3 wherein said ring shank is provided with a transverse hole open at a lateral face of said ring shank at a central location thereof and said mounting means comprises a wire seated in said hole and providing a loop for attachment to said dangling means.

6. A school ring charm according to claim 3 wherein said mounting means includes an eyelet fixedly secured on the underside of said ring shank to extend into said finger aperture of said ring, with the plane of the eyelet running transversely to the plane of the ring.

7. A school ring charm comprising a school ring having a shank and a ring top defining a finger aperture, identification means on the ring for identifying a particular school, dangling means for making eye-catching movement in said finger aperture, and mounting means for dangling said dangling means within the finger aperture of said ring, said dangling means being framed and protected in the finger aperture by the ring shank and top to permit said dangling eye-catching movement, said mounting means being connected to said ring shank at a central location thereof to support said dangling means so that said dangling means dangles within the finger aperture of said ring when said ring is in an inverted position with the ring top facing downwardly, said dangling means consisting of a pair of numerals indicative of a year.

8. A school ring charm comprising a school ring having a shank and a ring top defining a finger aperture, identification means on the ring for identifying a particular school, dangling means for making eye-catching movement in said finger aperture, and mounting means for dangling said dangling means within the finger aperture of said ring, said dangling means being framed and protected in the finger aperture by the ring shank and top to permit said dangling eye-catching movement, said mounting means being connected to said ring shank at a central location thereof to support said dangling means so that said dangling means dangles within the finger aperture of said ring when said ring is in an inverted position with the ring top facing downwardly, said dangling means consisting of a disc having information of school-related significance engraved on one face thereof.

9. A miniature school ring charm comprising a school ring having a shank and a ring top defining a miniature finger aperture, identification means on the ring for identifying a particular school, dangling means for making eye-catching movement in said finger aperture, and mounting means for dangling said dangling means within the finger aperture of said ring, said dangling means being framed and protected in the finger aperture by the ring shank and top to permit said dangling eye-catching movement, means for attaching said ring to a neck chain or the like to support said ring in an inverted position, said mounting means including an eyelet encircling said ring shank at a central location thereof, said ring shank being provided with a groove receiving said eyelet, said groove being formed in the outer surface of the shank and running parallel to the central axis of the ring.

10. A miniature school ring charm comprising a school ring having a shank and a ring top defining a miniature finger aperture, identification means on the ring for identifying a particular school, dangling information means for displaying information of school-related significance in said ring aperture and for making eye-catching movement in said ring aperture, and mounting means for dangling said information means within the finger aperture of said ring for displaying said information of school-related significance, said dangling information means being framed and protected in the ring aperture by the ring shank and top to permit said dangling eye-catching movement, said ring shank being provided with a groove formed in the outer surface of the shank and running parallel to the central axis of the ring charm, a radial groove formed in the shank and extending from said parallel groove to the inner surface of the shank, said information mounting means including an eyelet encircling said ring shank and seated within both of said grooves to set said information means forwardly in said ring aperture where it can be better seen, said grooves tending to keep said eyelet in vertical position.

* * * * *